United States Patent [19]

Rhodes

[11] 4,005,283

[45] Jan. 25, 1977

[54] SQUARING CIRCUIT APPARATUS

[75] Inventor: Melvin H. Rhodes, Cedar Rapids, Iowa

[73] Assignee: Rockwell International Corporation, El Segundo, Calif.

[22] Filed: Sept. 22, 1975

[21] Appl. No.: 615,753

[52] U.S. Cl. ..... 235/194; 307/229; 307/271; 328/144; 328/185

[51] Int. Cl.[2] ..... G06G 7/16; G06G 7/20

[58] Field of Search ..... 235/183, 193, 194; 307/229, 235 N, 271; 328/144, 185; 340/347 AD

[56] References Cited

UNITED STATES PATENTS

| | | | |
|---|---|---|---|
| 3,482,116 | 12/1969 | James | 307/235 N X |
| 3,484,593 | 12/1969 | Schmoock et al. | 307/229 X |
| 3,517,339 | 6/1970 | Hubbard et al. | 307/271 X |
| 3,539,825 | 11/1970 | Hardaway | 328/185 X |
| 3,588,713 | 6/1971 | Yareck | 235/194 X |
| 3,714,470 | 1/1973 | Goldberg | 307/229 X |
| 3,749,942 | 7/1973 | Moses | 307/271 |
| 3,778,794 | 12/1973 | Szabo et al. | 307/229 X |

OTHER PUBLICATIONS

D. F. Hoeschele, Jr.; Analog-To-Digital/Digital-To-Analog Conversion Techniques, Wiley & Sons, Inc., 1968, pp. 356-357.

*Primary Examiner*—Jerry Smith
*Attorney, Agent, or Firm*—Robert J. Crawford; Bruce C. Lutz

[57] ABSTRACT

A voltage squaring circuit utilizing an analog signal to pulse rate converter wherein the signals used to control the pulse rate switches are additionally used to control another set of switches fed by the input signal. Thus, the output signal is a pulse rate signal whose amplitude is directly representative of the input signal and these output signals are controlled in pulse rate in accordance with the amplitude of the input signal thereby producing an output representative of the square of the input signal.

3 Claims, 4 Drawing Figures

SQUARING CIRCUIT APPARATUS

THE INVENTION

The present invention is generally related to electronics and more specifically related to a circuit for squaring an input signal.

It is realized that there are many different types of voltage squaring circuits in the prior art, but it is believed that the present circuit for squaring a voltage is a new and novel approach to the problem.

In the present invention a circuit is used which integrates the sum of an input signal and a feedback signal to provide a signal which is applied to a pair of voltage sensitive switches. When the switch indicates that the amplitude of the signal exceeds a predetermined value in either of the positive or negative directions, it provides an output control signal to a first or second pair of switches which switches control the passage of a positive or negative signal for use in the feedback circuit. Thus, the average value of the pulse varying signal is used to counteract the input. If these control signals are then used to actuate simultaneously another set of switches and the input to these switches is supplied by the input signal, an output will be obtained which has an amplitude directly representative of the input signal and an average value which is representative of the square of the input signal since there is a pulse width to this amplitude which is controlled by the voltage sensitive switch.

It is therefore an object of the present invention to provide an improved squaring circuit.

Other objects and advantages of the present invention may be ascertained from a reading of the specification and appended claims in conjunction with the drawings wherein:

DESCRIPTION AND OPERATION OF FIGS. 1 AND 2

Figure 1:
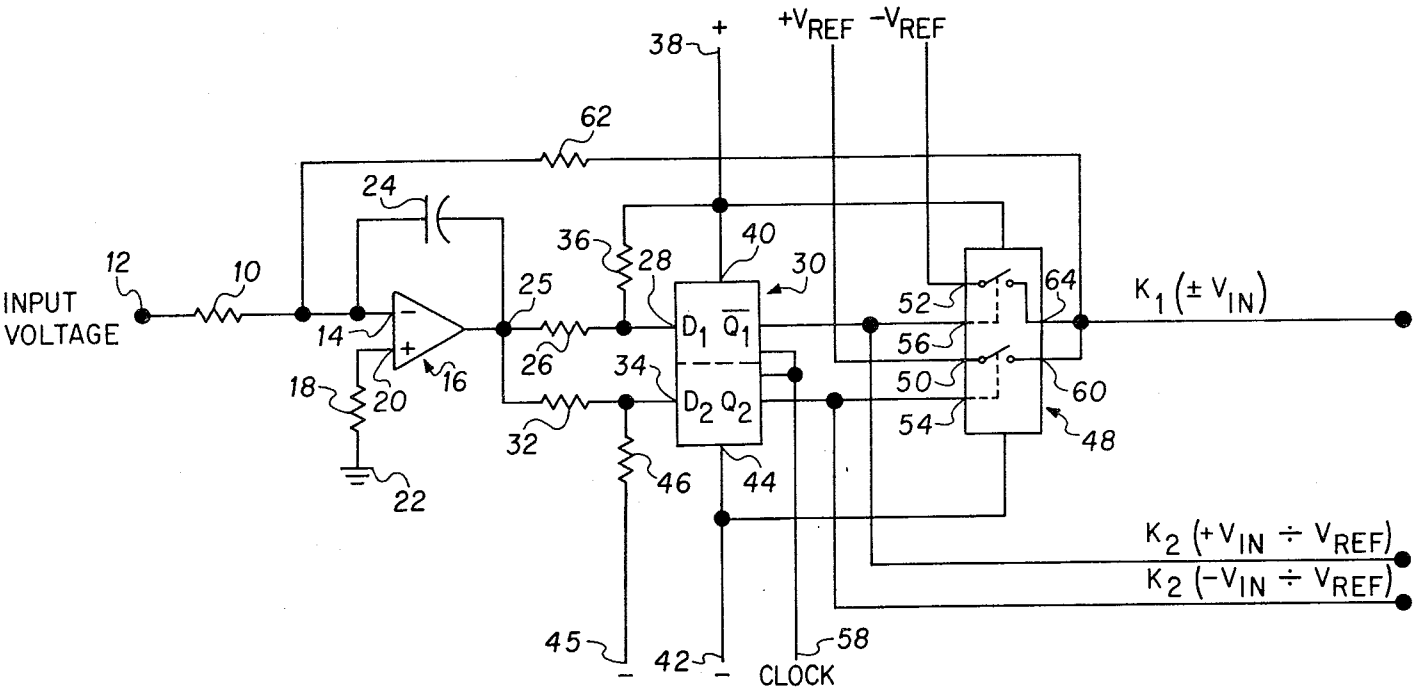
FIG. 1 is a schematic diagram of one embodiment of an analog signal to duty cycle converter.
Figure 2:
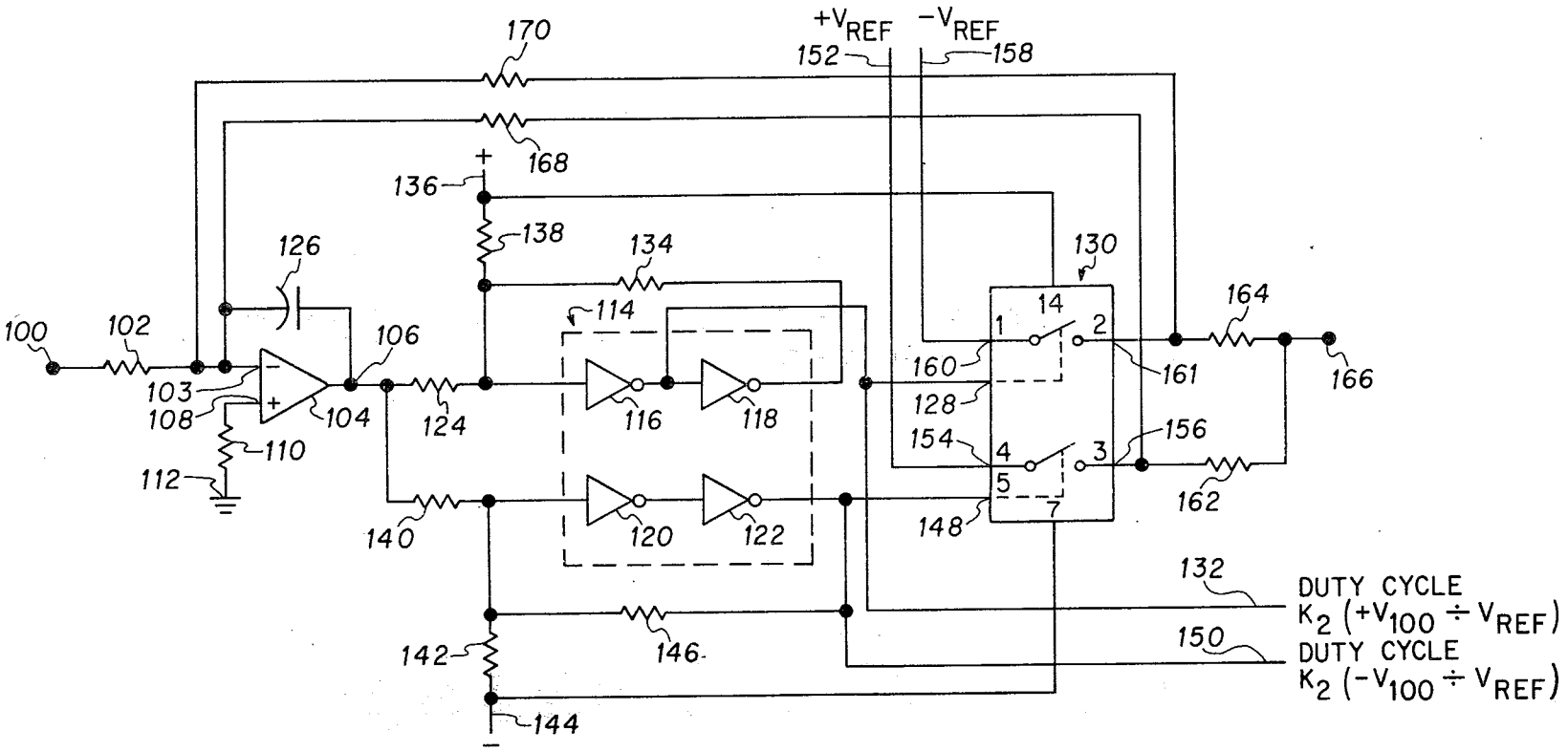
FIG. 2 is a schematic diagram of another embodiment of an analog signal to duty cycle converter.

While a detailed description of the operation of FIGS. 1 and 2 along with waveforms may be found in my copending application Ser. No. 615,758, filed 22 September 1975, a brief description of operation will be provided herein.

In FIG. 1, an input signal is applied at input 12 and is integrated by the combination of amplifier 16 and capacitor 24. The output of this integrator is then applied to the dual D flip-flop 30. Under initial conditions the $D_1$ flip-flop is off and a logic 1 is obtained from $\overline{Q}_1$ thereby driving the output of 16 positive to actuate the $D_1$ flip-flop and remove the logic 1 signal. If the input signal is positive and there is no feedback signal, this signal will be inverted and deactivate the $D_1$ flip-flop when the junction point between resistors 26 and 28 is driven in a negative direction a predetermined amount simultaneous with the occurrence of the next clock pulse on line 58. (Actuation of flip-flop $D_2$ requires an even more positive signal at junction point 25.) With the deactivation of flip-flop $D_1$, the switch connected to the minus reference potential is closed and a negative feedback signal is supplied through resistor 62 to be summed with the input signal. This negative feedback voltage is of a much larger amplitude than the input signal and thus will drive the integrator in the opposite direction until such time as the input to the $D_1$ flip-flop is far enough positive to again actuate this flip-flop. It will be noted that the false or $\overline{Q}$ output of the $D_1$ flip-flop is used. Thus, the minus $V_{ref}$ voltage is applied whenever $D_1$ flip-flop is in the inactive condition. On the other hand, the $D_2$ flip-flop has its $Q_2$ output actuating a switch and thus this output is provided whenever $D_2$ is actuated. Thus, the integrator 16 will change potential in one direction at one rate with only the input signal and will normally change in output potential at a much different rate when there is a combination of feedback signals and input signals. In this manner, the output of the apparatus of FIG. 1 at output 64 is a series of pulses, normally one clock pulse width, whose recurring frequency is directly representative of the amplitude of the input signal.

The apparatus of FIG. 2 is much like that of FIG. 1 except that the D flip-flops are replaced by inverters using feedback and thus there is an elimination of the clock. In this circuit, there is no waiting for the next clock pulse to occur although the feedback around the pair of inverters such as 116 and 118 will immediately add a signal to the input of inverter 116 upon switching thereof as a type of bipolarity hysteresis. Thus, a duty cycle is again obtained although the pulses are not of a constant width as is generally the case with the clocking type circuit of FIG. 1. As was the case with FIG. 1, the resistors 138, 124, 140 and 142 form a voltage dividing network such that the switching voltage of the upper set of inverters is biased to switch around a different level than the lower set of inverters. Although FIG. 2 illustrates two feedback resistors 168 and 170 as compared to the one feedback resistor 62 of FIG. 1, this is merely illustrative of different approaches of obtaining an output signal and both circuits function in a similar manner.

DETAILED DESCRIPTION OF FIGS. 3 AND 4

Figure 3:
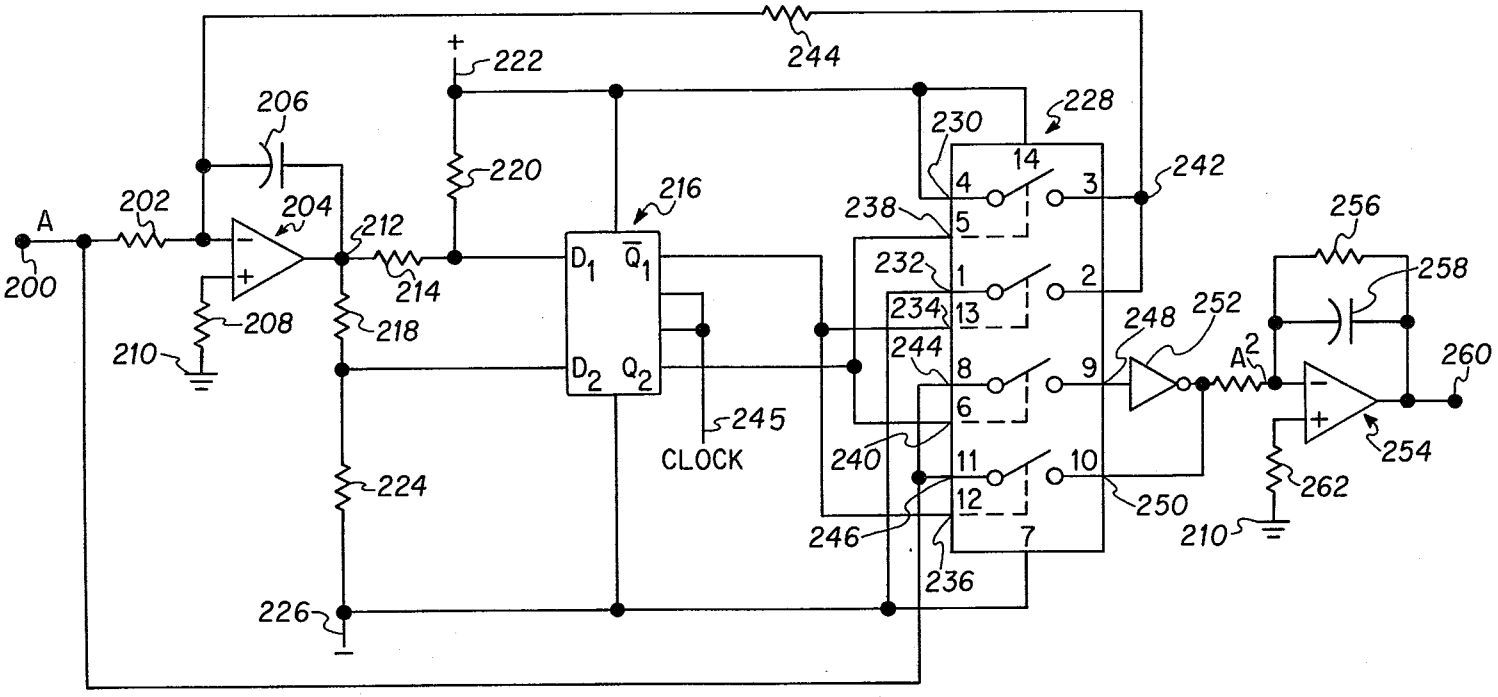
FIG. 3 is a schematic diagram of a squaring circuit using the teachings of FIG. 1.

In FIG. 3, an input 200 supplies input signals through a resistor 202 to the input of an integrating amplifier generally designated as 204 having a feedback or integrating capacitor 206. While the input signals are applied to an inverting input of amplifier 204, a resistor 208 is connected between the non-inverting input and ground or reference potential 210. Output of amplifier 204 is designated as 212 and is connected through a resistor 214 to a $D_1$ flip-flop of a dual D flip-flop generally designated as 216 and is also connected through a resistor 218 to a $D_2$ input of dual D flip-flop 216. A further resistor 220 is connected between the $D_1$ input and positive reference potential 222. The $D_2$ input is connected through a further resistor 224 to a negative reference potential 226. The power from terminals 222 and 226 are also supplied to the dual D flip-flop 216 as well as to power terminals of a multiswitch means 228. This switch 228 may be a switch such as sold by RCA under Part Number CD4016 and described as a quad bilateral switch. Internal to block 228 are a series of numbers designating the pin numbers used by RCA and are for the convenience of the reader. The mechanisms within the switch 228 are representative of the operation of this circuit and are used for clarity rather than the actual circuitry used by RCA. As will be realized, the actual circuitry of the RCA switch is not necessary and this example was given solely for the convenience of someone interested in building this circuit. The positive power is also supplied to an input 230 of block 228 while the negative power is supplied to an input designated as 232. A $\overline{Q}_1$ output of flip-flop 216 is supplied to input 234 and a further input 236 of block 228. A $Q_2$ output of flip-flop 216 is supplied to an input 238 and also to an input 240. As will be noted, inputs 238 and 234 control switches having their inputs connected to 230 and 232, respectively. The outputs of these switches are connected to a common junction 242 which supplies signals through a feedback resistor 244 to the inverting input of integrator 204. A clock lead 245 supplies clock signals to the dual D flip-flop 216. The input 200 is also connected to inputs 244 and 246 of block 228. These switches are controlled respectively by inputs 240 and 236 and are connected to output terminals 248 and 250, respectively. Output 248 is connected through an inverter 252 to output 250 as well as to an inverting input of a differential amplifier generally designated as 254. Amplifier 254 has a feedback resistor 256 and a feedback capacitor 258 such that this amplifier provides a smoothing filter function. An output of amplifier 254 is labeled 260 and a non-inverting input of this amplifier is connected through a resistor 262 to ground or reference potential 210.

Figure 4:
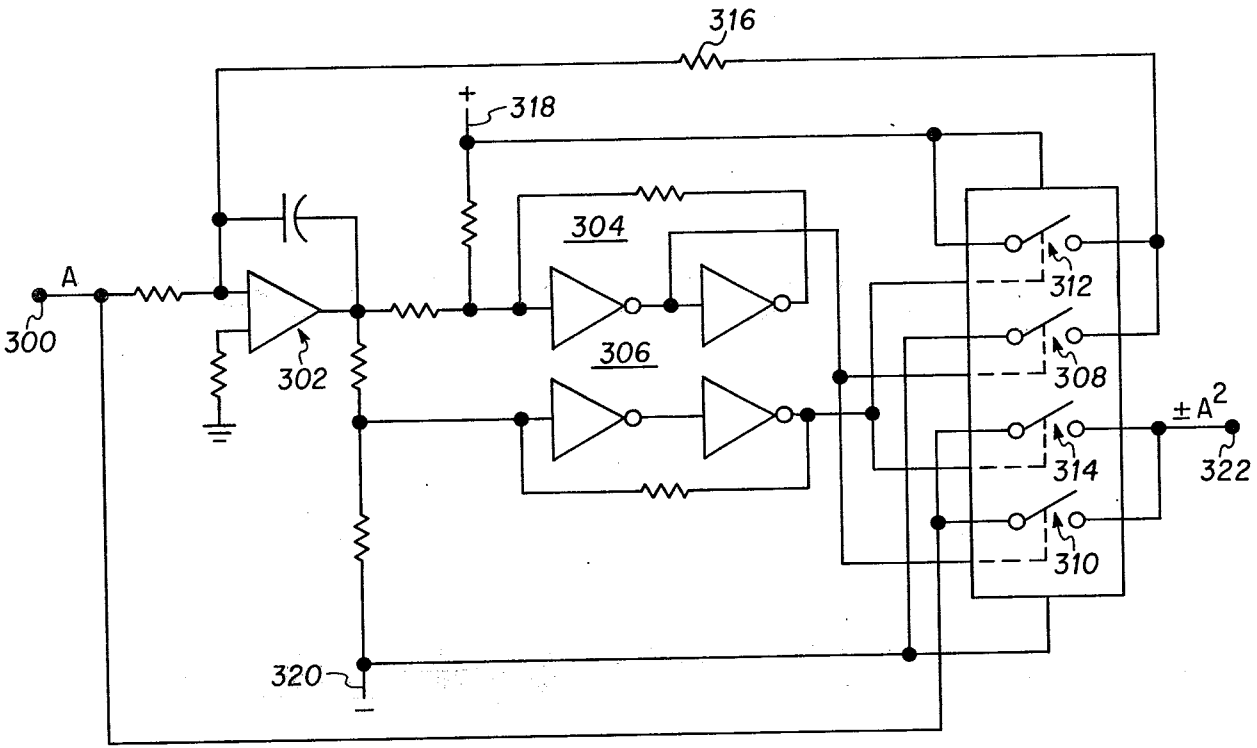
FIG. 4 is a schematic diagram of a squaring circuit using the teachings of FIG. 2.

FIG. 4 is very similar to that of FIG. 3 except that the dual D flip-flop is replaced by a set of inverters for providing the voltage sensitive switching function and the output of the gating means represents the square of the input and contains the same polarity as the input.

In view of the above, only a few designators will be given FIG. 4. An input signal is supplied to an input 300 and is passed through an integrator 302 and supplied to an upper set of inverters generally designated as 304 and to a lower set of inverters generally designated as 306. The set of inverters 304 is used to actuate switches 308 and 310. The set of inverters 306 are used to actuate gating means 312 and 314. The outputs of gating means 308 and 312 are connected together and supply feedback signals through a resistor 316 to the integrating means 302. The input of gating means 312 is connected to a positive power terminal 318 while the input of gating means 308 is connected to a negative power terminal 320. The input signal supplied on 300 is supplied to the inputs of both gating means 310 and 314 and their outputs are connected together to supply a plus or minus input signal squared on lead 322.

Operation of FIGS. 3 and 4

As may be ascertained, the upper portion of FIG. 3 operates substantially identically with that of FIG. 1. The integrator 204 provides an output which is indicative of the integrated average value of the inputs from input 200 and the feedback signal from 244. This output is used to activate one of the flip-flops $D_1$ and $D_2$ on a periodic basis when the output from integrator 204 exceeds a predetermined voltage level as determined by the biasing network comprising the four resistors 220, 214, 218 and 224. The $D_1$ flip-flop in normal conditions is activated and thus there is no output on the $\overline{Q}_1$ output. In normal conditions, the $D_2$ flip-flop is not activated and there is also no output from the $Q_2$ output. By normal conditions, I mean when there is no output from integrator 204 as a result of there being no input from input 200. Under these conditions, both of the upper switches in gating means 228 are in an open condition and there is no feedback signal. If the output from 204 is either positive or negative, either the flip-flop $D_1$ or $D_2$ will change states and provide a gating signal to the gates in 228. This gating produces the duty cycle conversion discussed in connection with FIG. 1 and the aforementioned related application. As will be realized, this duty cycle change is obtained by an increase in frequency of pulses due to the application of either increasing positive or negative potentials on leads 230 and 232 to the output of 242.

The output signal from 216 also activates the lower two switches. As may be ascertained, the input to these two lower switches are both obtained from the input signal 200. Thus, the input signal is provided to the output 260 as a function of the amplitude of the input signal. Thus, as the input signal amplitude increases, the output increases both in amplitude and in pulse duty cycle. This increase is indicative of the square of the input. As illustrated in FIG. 3, a negative going input periodically activates the $D_2$ flip-flop which operates the second lowest switch. This output is inverted in inverter 252 to produce a positive signal as normally is obtained numerically from squaring a negative number. A positive going signal will activate the $D_1$ flip-flop which operates the lowermost switch in 228 and thus this output need not be inverted. Thus, the input to amplifier 254 is a pulse duty signal which is always positive regardless of the polarity of the input at 200. The pulse duty can be averaged using the filter circuit incorporating amplifier 254 such that the output at 260 is a direct voltage signal which is a squared function of the input at 200.

The upper portion of FIG. 4 is substantially identical with that of FIG. 2 and the entire circuit operates very similar to that of FIG. 3. In other words, the integrator 302 provides an output indicative of the average summation of the input from 300 and the feedback resistor 316 to activate the upper or lower set of voltage sensitive switches 304 and 306. These switches each incorporate a feedback signal to produce a hysteresis effect since there is no clock such as is used in FIG. 3. The hysteresis effect keeps the control signal output at a given potential until the feedback signal through 316 is able to alter the output of 302 a sufficient amount and in a direction opposite the previous direction. The activation of either of the voltage sensitive switches activates one of the upper two switches to produce this feedback signal. Simultaneous therewith, the voltage sensitive switches 304 and 306 activate one of the two lower switches to provide a squared amplitude indication at 322. In FIG. 4, the inverter was left off the second lowest switch since in some instances it is desired to have an output signal which is indicative in sign of the signal being squared and yet have an amplitude which is indicative of the square of the input signal. Such a result is obtained by removing the inverter such as 252 of FIG. 3.

As may be realized, the circuits of FIGS. 3 and 4 can be used to additionally provide plain pulse duty cycle conversion of the input such as is illustrated in FIGS. 1 and 2 by merely taking the output from the appropriate place in addition to providing the squared function output as illustrated.

As will be apparent to those skilled in the art, many alterations may be made to the circuit while still staying within the teachings of my invention of providing a squaring circuit using duty cycle conversion. Therefore, I wish to be limited only by the scope of the appended claims.

What is claimed is:

1. Squaring apparatus comprising, in combination:

apparatus input means for supplying an analog input signal to be squared;

duty cycle means, connected to said input means for receiving signals therefrom, for providing output control signals having a duty cycle representative of the amplitude of said input signals; and apparatus gating means, including input means connected to said apparatus input means, control means connected to said duty cycle means for receiving control signals therefrom and first and second output means, for supplying output signals from one of said first and second output means in accordance with the polarity of said analog input signal and representative in amplitude of the square of said input signal, wherein said duty cycle means is a converter including, first switch means including first and second gating means each having an input means, an output means and a control means for controlling a conductive path between said input means and said output means of the gating means, first and second feedback signal source means connected to said input means of said first and second gating means respectively of said first switch means;

integrating means including input means and output means, analog signal supplying means for supplying the input signal to be squared, means connecting said analog signal supplying means and said output means of said first switch means to said input means of said integrating means, voltage sensitive second switch means including input means and control signal first and second output means, said second switch means providing an output of a given polarity at said first output means thereof when a signal at said input means thereof exceeds a first reference level and the second output means thereof providing an output signal of said given polarity when a signal provided to said input thereof exceeds a second reference level, means connecting said output means of said integrating means to said input means of said second switch means, means connecting said control output means of said second switch means to said control means of said first switch means, the output signal from said control output means of said voltage sensitive switch means being representative in duty cycle of the amplitude of signals provided by said analog signal supplying means, and wherein said apparatus gating means includes inverting means connected within said apparatus gating means and to the one of said output means providing output signals with negative polarity analog input signals; and means connecting an output of said inverting means to the other output means of said apparatus gating means for supplying apparatus output signals whereby the squared apparatus signal is positive regardless of the polarity of said input signal to be squared.

2. Apparatus as claimed in claim 1 wherein said second switch means comprise a pair of D-type flip-flops.

3. Apparatus as claimed in claim 1 wherein said second switch means comprises two pairs of feedback connected inverters.

* * * * *